United States Patent [19]

McGurk

[11] 4,219,949

[45] Sep. 2, 1980

[54] PICTURE FRAME

[76] Inventor: Stanley E. McGurk, 697 Victoria Ave., Westmount, Quebec, Canada

[21] Appl. No.: 969,202

[22] Filed: Dec. 13, 1978

[51] Int. Cl.[3] ..... G09F 1/12

[52] U.S. Cl. ..... 40/156

[58] Field of Search ..... 40/152, 155, 156; 248/488, 490

[56] References Cited

U.S. PATENT DOCUMENTS

| | | | |
|---|---|---|---|
| 2,633,653 | 4/1953 | Angus et al. | 40/156 |
| 3,541,714 | 11/1970 | Bruck | 40/156 |
| 3,956,839 | 5/1976 | Yoshida | 40/156 |
| 3,981,091 | 9/1976 | Wiener | 40/156 |

FOREIGN PATENT DOCUMENTS

| | | | |
|---|---|---|---|
| 325219 | 3/1935 | Italy | 40/156 |

*Primary Examiner*—Louis G. Mancene
*Assistant Examiner*—Wenceslao J. Contreras
*Attorney, Agent, or Firm*—Swabey, Mitchell, Houle, Marcoux & Sher

[57] ABSTRACT

A mounting unit for mounting a print, or the like, between a pane of glass or sheet of translucent plastic and a backing board. The unit has a mounting plate with means for connecting the plate to the back of the backing board adjacent an edge of the board. A U-shaped mounting channel fits loosely over the edges of the sandwiched glass/plastic, print and board, and the connected plate. Wedges fit between one side of the connected plate and the mounted channel to clamp the glass and board tightly between the other side of the plate and the channel. The wedge also cooperates with locking means on the plate and channel to lock the channel to the plate.

1 Claim, 6 Drawing Figures

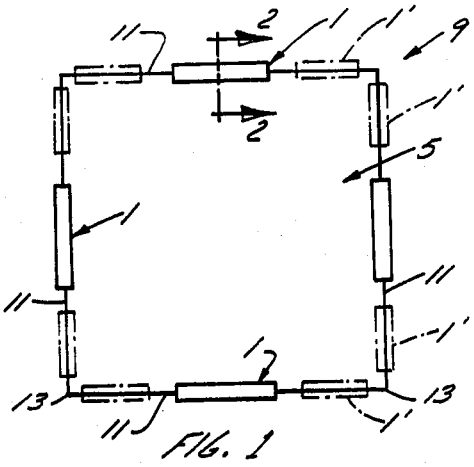
FIG. 1
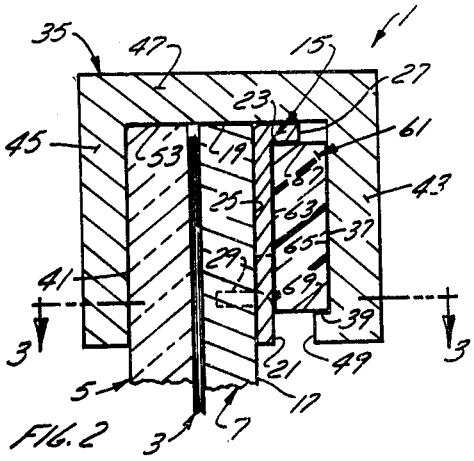
FIG. 2
FIG. 3
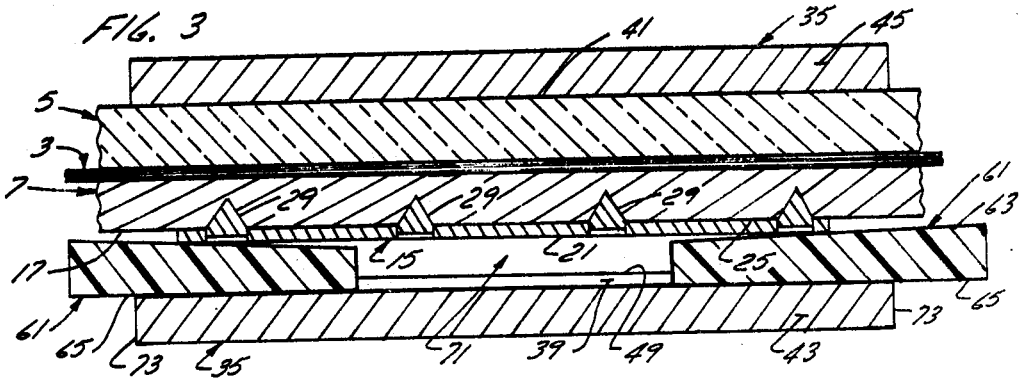
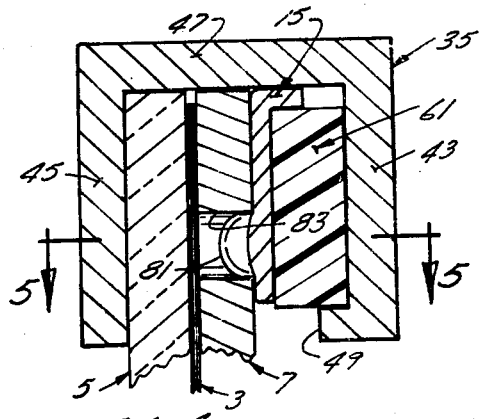
FIG. 4
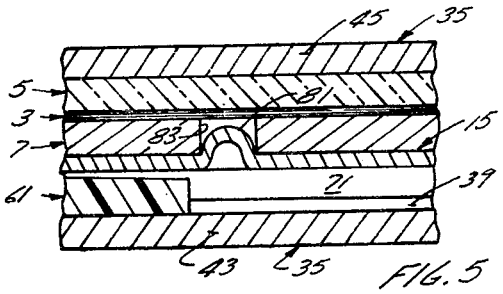
FIG. 5
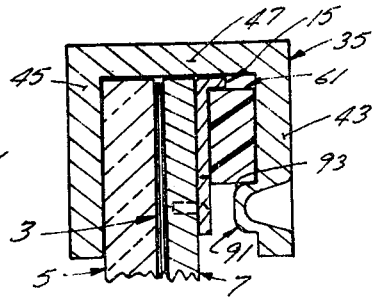
FIG. 6

PICTURE FRAME

BACKGROUND OF THE INVENTION

1. Field of the Invention

This invention is directed to a mounting unit for use in mounting a flexible sheet between a rigid transparent cover and a rigid backing board.

2. Description of the Prior Art

Art prints, photographs, and the like are usually mounted on a rigid backing board under a pane of glass. A frame is mounted about the edges of the board and glass to both securely press the board and glass together against the print and to also provide a decorative effect. The frame, being unitary about the picture, also provides secure means by which the picture can be hung. Framing is, however, expensive. It is also very time consuming to mount, and this adds to the expense. It is also time consuming and thus expensive to remove the frame in order to replace the print to be displayed.

To reduce the cost of displaying art prints and the like, it is known to use various types of clips spaced about the edges of both the glass and the backing board to secure the glass and board together with the print held therebetween. The clips are much cheaper to use and easier to handle than a full frame. However, because they are individual units, and only held by friction, they cannot be safely used to suspend a large, heavy picture therefrom.

SUMMARY OF THE INVENTION

It is the object of the present invention to provide a mounting unit, a number of which can be used to replace a frame in mounting a print or the like.

It is another object of the present invention to provide mounting units from which pictures can be safely hung.

It is yet another object of the present invention to provide mounting units for use in mounting a print or the like which are inexpensive to manufacture and which are simple and reliable to use.

It is a further object of the invention to provide mounting units which are aesthetical.

The mounting unit of the present invention comprises a mounting plate which is connected by suitable means to the back of a mounting board; a U-shaped mounting channel which is loosely mounted on the sandwiched glass, print and mounting board, and the connected mounting plate; and wedges which fit between the plate and one leg of the channel to tightly mount the channel in plate against the glass and the board. In addition, locking means, cooperating with the wedges, are provided on both the channel and the plate to lock the channel and the plate together.

Since the mounting plate is connected to the mounting board and since the channel is locked to the plate, the picture can be safely suspended from the channel.

The use of the wedges provides simple means for both clamping the print in place and locking the channel in place. The wedges are easily removed when it is desired to replace the print.

The invention is particularly directed toward a mounting unit for use in mounting a flexible sheet between a transparent cover and a backing board. The mounting unit includes a mounting plate and means for connecting the mounting plate to the back of the backing board adjacent an edge of the board. The mounting plate has a flange extending therefrom along one side, and this flange is positioned at the edge of the board when the plate is connected to the board. A U-shaped channel member is provided, sized to loosely fit over the edges of the cover, the sheet, and the board, and the connected plate. Locking means extend inwardly from one of the legs of the channel member, near its free end. At least one wedge member is provided to wedge between one side of the connected plate and the one leg of the channel to clamp the cover tight against the board between the other leg of the channel and the other side of the plate. In addition, the wedge fits snugly between the flange on the plate and the locking means on the one leg to lock the channel to the plate.

The invention is more particularly directed toward a mounting unit for use in mounting a flexible sheet between a rigid transparent cover and a rigid mounting board. The mounting unit comprises a first mounting member having a first cam surface and a first locking surface generally perpendicular to the first cam surface. Connecting means are on the first mounting member to connect it to the back surface of the mounting board by an edge portion of the board with the cam surface facing away from the back surface of the board and with the locking surface facing inwardly from the edge portion of the board. The connecting means prevents movement of the first mounting member toward or away from the edge portion when the first mounting member is connected to the board.

A second mounting member is included having a second cam surface, a second locking surface adjacent and generally perpendicular to the second cam surface, and a clamping surface facing the second cam surface. The second member is shaped to loosely fit over the sandwiched cover, flexible sheet and board and the connected first mounting member at the edge portion of the board with the clamping surface adjacent the outer surface of the cover, the second cam surface facing the first cam surface and the second locking surface facing the first locking surface.

At least one cam member having opposed side cam surfaces is provided, the cam member insertable between the first and second cam surfaces, when the second mounting member is mounted over the connected first mounting member. The cam surfaces on the cam member wedge the first and second cam surfaces apart to have the clamping surface press the cover tight against the board. The cam member also fits snugly between the first and second locking surfaces to lock the second mounting member in place.

BRIEF DESCRIPTION OF THE DRAWINGS

The invention will now be described in detail having reference to the accompanying drawings, in which:

FIG. 1 is an elevation view of a picture;

FIG. 2 is a cross-section view taken along line 2—2 of FIG. 1;

FIG. 3 is a cross-section view taken along line 3—3 of FIG. 2;

FIG. 4 is a cross-section view similar to FIG. 2 showing another embodiment of the invention;

FIG. 5 is a cross-section view taken along line 5—5 of FIG. 4; and

FIG. 6 is a cross-section view similar to FIG. 2 showing yet another embodiment of the invention.

DESCRIPTION OF THE PREFERRED EMBODIMENTS

The picture mounting unit 1 of the present invention is used to mount a flexible sheet 3 between a rigid transparent cover 5, and a rigid backing board 7 to provide a picture 9. The sheet 3 can comprise an art print, the cover 5 usually comprises a pane of glass, and the backing board 7 usually comprises a sheet of fiberboard or similar material.

As shown in FIG. 1, four mounting units 1 can be used to mount a rectangular print 3, one unit located on each edge 11 of the picture 9. Each mounting unit 1 is located at about the center of each edge. Alternatively, the mounting units 1' can be located along each edge 11 as shown in broken lines in FIG. 1, each unit 1' on each edge 11 located adjacent a corner 13 of the picture 9.

Each mounting unit 1 includes a first mounting member 15 adapted to be connected to the back surface 17 of the backing board 7 adjacent its edge 19. The first mounting member 15 has a first camming surface 21 and a first locking surface 23. The locking surface 23 is generally perpendicular to the first camming surface 21. The first mounting member 15 preferably comprises a rectangular, metal plate with one side of the plate providing the first camming surface 21. The other side 25 of the plate lies against the back surface 17 of board 7 when the plate is connected to the board. The plate 15 is bent along one side to provide a narrow flange 27. The flange 27 extends at a right angle to the remainder of the plate. The inner surface of the flange 27 forms the first locking surface 23.

The plate 15 can be connected to the backing board 7 by any suitable means. In a preferred embodiment, as shown in FIGS. 2 and 3, a row of V-shaped teeth 29 are partially punched out in the plate 15 and the teeth are then bent from the plate in a direction away from, and generally perpendicular to, cam surface 21. The plate 15 is connected to the board 7 by driving the teeth 29 into the back surface 17 of board 7 with the flange 27 positioned generally even with the edge 19 of the board.

The mounting unit 1 includes a second mounting member 35 having a second camming surface 37, a second locking surface 39, and a clamping surface 41. The second mounting member 35 can be in the form of a metal, U-shaped channel member having a pair of generally parallel legs 43, 45 extending perpendicularly from a base 47. An inwardly extending flange 49 is preferably provided at the end of one of the legs 43. The flange 49 is generally parallel to base 47 of channel member 35. The inner surface of the leg 43 provides the second camming surface 37 and the inner surface of the leg 45 provides the clamping surface 41. The inner surface of the flange 49 provides the second locking surface 39.

The channel mounting member 35 is sized to comfortably fit over the edges of the glass, the print and the mounting board and also over the connected mounting plate 15 with the base 47 lying adjacent the glass edge 53 and the board edge 19. When the channel member 35 is fitted over glass and board, its leg 45 is adjacent glass 5 and its leg 43 is spaced slightly from plate 15. Second cam surface 37 faces first cam surface 21 and second locking surface 39 faces first locking surface 23.

The mounting unit 1 includes at least one, but preferably a pair of cam members or wedges 61 to lock the plate and channel members 15, 35 together when the channel member 35 is mounted over the strip member 15. The wedge members 61 are sized to be tightly wedged in the space between the first camming surface 21 on plate 15 and the second camming surface 37 on channel member 35. The wedge members 61 are generally rectangular in shape having opposed side surfaces 63, 65 which slope toward each other and form cam surfaces. The top and bottom surfaces 67, 69 are parallel. When the wedge members 61 are moved into the space 71 between the plate 15 and channel 35 from the ends 73 of the channel member 35, the opposed cam surfaces 63, 65 cooperate with cam surfaces 21, 37 respectively to cam them apart and to thus have the clamping surface 41 press tightly against the glass to clamp it against the board with the print therebetween.

In addition to camming the cam surfaces 21, 37 apart, each wedge 61 also fits snugly between the locking surfaces 23, 39 on the plate 15 and channel member 35 respectively to lock the channel member 35 in place. The top and bottom surfaces 67, 69 of the wedge 61 lie adjacent the locking surfaces 23, 39 respectively to prevent removal of the channel from the connected plate. Suitable means can, therefore, be provided on one or more of the channel members to hang the picture. The mounting units 1 are easily removed to remove or change the print 3 by withdrawing the wedges 61 from between the plate 15 and channel 35 and lifting the channel 35 off. The channel members 35 are neat and clean in appearance and do not detract from the picture.

The mounting plate 15 can be fastened to the mounting board in different ways. Instead of using a row of teeth 29 as shown in FIGS. 2 and 3, a row of generally circular projections 81 can be formed on the plate 15 projecting therefrom in a direction opposite to the flange 27. The projections 81 can be formed by "dimpling" the plate. A row of holes 83 are formed in the backing board 7 to receive the projections 81. The holes 83 are shaped and sized to snugly receive the projections 81 and can extend through the board 7. The row of holes 83 are parallel to the edge 19 of the board and are positioned to locate the flange 27 of the plate 15 generally even with the edge 19 of the board when the plate is placed against the board with the projections 81 extending into the holes 83. The projections in the holes fix the plate 15 to the board with regard to movement in any direction parallel to the board. The channel member 35 and wedges 61 then fix the plate 15 to the board 7 with regard to movement away from and perpendicular to the board.

In another embodiment of the invention shown in FIG. 6, the flange 49 on leg 43 of the channel member 37 can be replaced with a row of inwardly directed projections 91. The projections 91 can be formed by dimpling the leg 43. The upper surface 93 of the dimples 91 provided a discontinuous locking surface which cooperates with wedge 61 and first locking surface 23 to lock the channel 37 in place.

I claim:

1. A picture frame comprising a sandwich made up at least of a rigid transparent cover and a rigid mounting board, a mounting unit, including a first mounting member having a first cam surface and a first locking surface generally perpendicular to the first cam surface; connecting means on the first mounting member to connect it and retain against movement to the back surface of the mounting board by an edge portion of the board with the cam surface facing away from the back surface of the board and with the locking surface facing inwardly from the edge portion of the board, the connecting means preventing movement of the first mounting member toward or away from the edge portion when the first mounting member is connected to the board;

a second mounting member having a second cam surface, a second locking surface adjacent and generally perpendicular to the second cam surface, and a clamping surface facing the second cam surface; the second member loosely fitting over the edge of the sandwich and the connected first mounting member at the edge portion of the board with the clamping surface adjacent the outer surface of the cover, the second cam surface facing the first cam surface and the second locking surface facing the first locking surface;

and at least one cam member having opposed side cam surfaces; the cam member insertable between the first and second cam surfaces, when the second mounting member is mounted over the connected first mounting member, to have the cam surfaces on the cam member wedge the first and second cam surfaces apart to have the clamping surface press the cover tight against the board; the cam member also fitting snugly between the first and second locking surfaces to lock the second mounting member in place.

* * * * *